US006053026A

United States Patent [19]

Nardiello et al.

[11] Patent Number: 6,053,026

[45] Date of Patent: Apr. 25, 2000

[54] BLOCK-SET FORM DIE ASSEMBLY

[75] Inventors: Jerrell A. Nardiello, Hicksville; Robert J. Christ, Brentwood; John M. Papazian, Great Neck, all of N.Y.

[73] Assignee: Northrop Grumman Corporation, Los Angeles, Calif.

[21] Appl. No.: 09/168,353

[22] Filed: Oct. 7, 1998

[51] Int. Cl.[7] ..... B21D 37/00

[52] U.S. Cl. ..... 72/413; 72/297

[58] Field of Search ..... 72/413, 414, 446, 72/448, 297

[56] References Cited

U.S. PATENT DOCUMENTS

| | | | |
|---|---|---|---|
| 3,116 | 6/1843 | Watchman . | |
| 39,886 | 11/1863 | Cochrane . | |
| 48,538 | 7/1865 | Easby . | |
| 211,908 | 2/1879 | Houlihan . | |
| 316,820 | 4/1885 | Pessenger | 72/413 |
| 474,661 | 5/1892 | Holzapfel | 72/413 |
| 1,019,073 | 3/1912 | Nazel . | |
| 1,826,783 | 10/1931 | Hess . | |
| 1,830,647 | 11/1931 | Engel . | |
| 3,181,331 | 5/1965 | Wishing | 72/215 |
| 4,212,188 | 7/1980 | Pinson | 72/413 |
| 4,548,065 | 10/1985 | Vyhnal | 72/413 |
| 5,187,969 | 2/1993 | Morita | 72/446 |
| 5,471,856 | 12/1995 | Suzuki et al. | 72/1 |
| 5,546,784 | 8/1996 | Haas | 72/413 |

FOREIGN PATENT DOCUMENTS

| | | | |
|---|---|---|---|
| 267202 | 4/1989 | Germany | 72/413 |
| 95829 | 4/1980 | Japan | 72/413 |
| 70330 | 9/1988 | Japan | 72/297 |
| 133622 | 5/1989 | Japan | 72/413 |
| 226365 | 8/1994 | Japan | 72/413 |
| 900654 | 7/1962 | United Kingdom | 72/413 |

*Primary Examiner*—Daniel C. Crane
*Attorney, Agent, or Firm*—Terry J. Anderson; Karl J. Hoch, Jr.

[57] ABSTRACT

A block-set form die assembly (14) for press or stretch forming a product (12), such as a sheet metal product, is provided. In one embodiment, the block-set form die assembly (14) comprises a pin box (18) having a number of pins (20) contained within a containment box (22). The pins (20) within the containment box (22) can extend longitudinally to form a surface contour (24). A set-block (26) engages the pins (20) to set the longitudinal extension of the pins (20) to form the surface contour (24).

21 Claims, 2 Drawing Sheets

BLOCK-SET FORM DIE ASSEMBLY

TECHNICAL FIELD OF THE INVENTION

This invention relates generally to the field of sheet metal dies, and more particularly to a block-set form die assembly.

BACKGROUND OF THE INVENTION

Sheet metal is used in nearly all products, and range from the simple such as the tab on a pen, to the complex such as the skin on an aircraft. In general the sheet metal is press formed or stretch formed into the required shape. Press forming is generally accomplished by pressing the sheet metal between form dies that bend or impart the proper contour into the sheet metal. Stretch forming is generally accomplished by stretching the sheet metal over the form die to impart the proper contour into the sheet metal.

The contour of the form die is generally different from the contour imparted into the sheet metal due to the spring back of the sheet metal during the forming process. The contours of the form die are generally varied until the correct contour is imparted into the sheet metal.

One type of conventional form die is a machined form die. The machined form die is produced by machining the contours into the die to impart the correct contours into the sheet metal. Conventional machined form dies have several disadvantages. For example, machined form dies cannot be easily reworked and often have contour and surface finish requirements that are expensive to produce. In addition, machined form dies are generally large and bulky, making them expensive to store and maintain.

Another type of conventional form die is a self-adjusting discrete element form die. The self-adjusting discrete element form die generally has pins that can be adjusted to vary the height of each pin relative to the other pins. The variation in height of the pins forms the contour in the form die that is imparted into the metal product. The pins are mechanically adjusted to the required height. Some self-adjusting discrete element form dies require manual adjustment of the pins, whereas, other self-adjusting discrete element form dies use a computer controlled automated adjustment system. Conventional self-adjusting discrete element form dies have several disadvantages. For example, self-adjusting form dies are often prohibitively expensive. In addition, self-adjusting form dies can be damaged by the application of high compressive loads that are required in some die forming processes.

SUMMARY OF THE INVENTION

Accordingly, a need has arisen for an improved form die. The present invention provides a block-set form die assembly that substantially reduces or eliminates problems associated with prior methods and systems.

In accordance with one embodiment of the present invention, a block-set die form assembly is provided. The block-set die form assembly comprises a pin box having a number of pins contained within a containment box. The pins within the containment box can be extended longitudinally to form a surface contour. A set-block engages the pins to set the longitudinal extension of the pins to form the surface contour. In a particular embodiment, the set-block comprises pin cavities in which spacers are used to set the longitudinal extension of the pins.

In accordance with another embodiment of the present invention, a tooling die assembly for fabricating a product is provided. The tooling die assembly comprises a reactive load assembly and a block-set form die assembly as described above. The reactive load assembly operates to react a force on the product and shape the product to the surface contour of the block-set form die assembly.

Technical advantages of the present invention include providing an inexpensive and reconfigurable tooling die assembly for producing press and stretch formed products. In particular, the set-block allows the block-set die assembly to be easily reconfigured to fabricate different products without expensive rework operations.

Another technical advantage of the present invention is that the surface contour can be quickly changed by changing the size of the spacers used in the set-block, by reworking an existing set-block, or fabricating a new set-block. Accordingly, temporary changes to the surface contour to determine their effect on the product can be easily and inexpensively performed.

Yet another technical advantage of the present invention is that the set-block is smaller than many conventional form dies and is generally less expensive to store and maintain.

A further advantage is that one set of pins and one pin box with many set-blocks leads to lower investment and reduced storage requirements.

Other technical advantages will be readily apparent to one skilled in the art from the following figures, descriptions, and claims.

BRIEF DESCRIPTION OF THE DRAWINGS

For a more complete understanding of the present invention and the advantages thereof, reference is now made to the following description taken in conjunction with the accompanying drawings, wherein like referenced numerals represent like parts, in which.

DETAILED DESCRIPTION OF THE INVENTION

FIGS. 1 through 4 illustrate a tooling die assembly that utilizes a block-set form die assembly. As described in greater detail below, the block-set die form assembly comprises a pin box and a set block. The pin box comprises a number of pins that extend outwardly from a containment box. The set-block sets the height of the pins above the containment box such that the pins form a surface contour. Different set-blocks may be used in conjunction with the pin box to produce different surface contours.

Figure 1A:
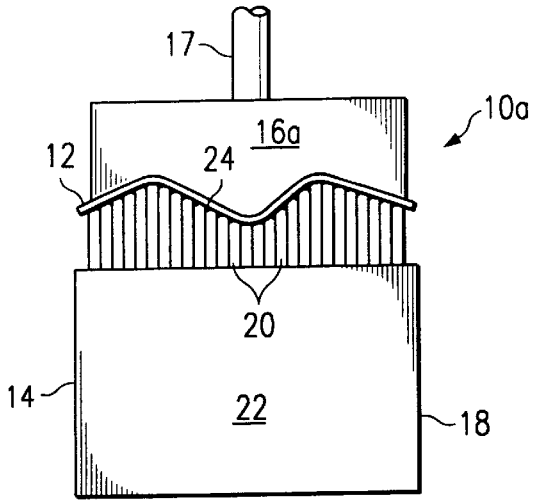
FIG. 1*a* is a side view of a tooling die assembly for press forming a product in accordance with the present invention.

FIG. 1A is a side view of a tooling die assembly 10*a* used to press form a product 12. In this embodiment, the tooling die assembly 10*a* comprises a block-set form die assembly 14 and a reactive load assembly 16*a*. As will be described in greater detail below, the block-set form die assembly 14 forms a surface contour that is to be imparted into the product 12. The reactive load assembly 16*a* produces a reactive load on the product 12 in order to bend, or form, the product 12 to the contours of the block-set die assembly 14.

In this embodiment, the product 12 is generally fabricated from sheet metal that is placed between the block-set form die assembly 14 and the reactive load assembly 16*a*. An actuator 17 is generally used to apply a load to the block-set form die assembly 14 and the reactive load assembly 16*a* to press form the sheet metal to the contours of the block-set form die assembly 14 and form the product 12. It will be understood that the product 12 may also be fabricated from other suitable materials without departing from the scope of the present invention. For example, the product 12 may be fabricated from suitable plastic and composite materials.

In the embodiment illustrated, the reactive load assembly 16*a* comprises a block-set form die assembly that has a reverse image of the surface contour set in the block-set form die assembly 14. In another embodiment, the reactive load assembly 16*a* comprises a pliable material that produces a force on the product 12 to form the product 12 to the surface contour of the block-set form die assembly 14. In yet another embodiment, the reactive load assembly 16*a* is a pliable bladder that is pressurized to produce a force on the product 12 and form the product 12 to the contours of the block-set die assembly 14. It will be understood that the reactive load assembly 16*a* may comprise any suitable device without departing from the scope of the present invention.

As will be discussed in greater detail below, the block-set die assembly 14 comprises a pin box 18 and a block-set. The pin box 18 comprises a number of pins 20 contained within a containment box 22. The pins 20 extend longitudinally outwardly from the containment box 22 and form a surface contour 24. As will be discussed in greater detail below, a set-block establishes the longitudinal extension, or height, of the pins 20. The surface contour 24 forms the contour that is imparted into product 12. The block-set die assembly 14 can be configured for any number of surface contours 24 by varying the longitudinal extension of the pins 20 relative to one another.

The containment box 22 operates to laterally restrain the pins 20 while still allowing the pins 20 to move longitudinally within the containment box 22. The containment box 22 may have any suitable shape or design.

Figure 1B:
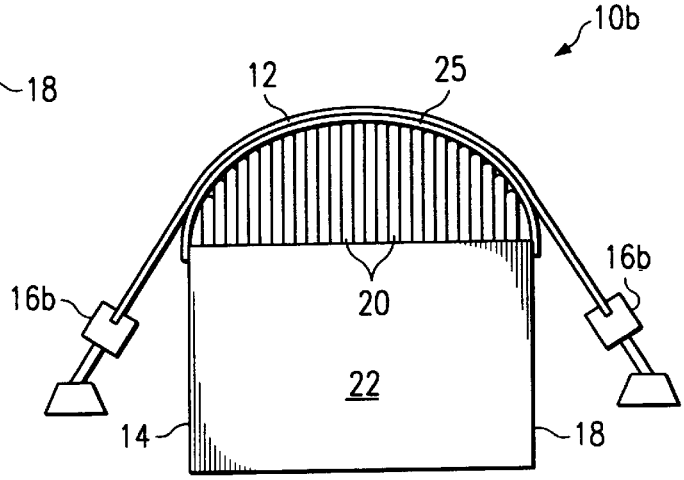
FIG. 1*b* is a side view of a tooling die assembly for stretch forming a product in accordance with the present invention.

FIG. 1B is a side view of a tooling die assembly 10*b* used to stretch form the product 12. In this embodiment, the tooling die assembly 10*b* comprises the block-set form die assembly 14 and a reactive load assembly 16*b*. The reactive load assembly 16*b* restrains the product 12 during a stretching operation. In one embodiment, as illustrated in FIG. 1B, the reactive load assembly 16*b* comprises clamps that grip the peripheral edge of the product 12. For example, in a sheet metal application, the sheet metal is restrained by the clamps, and the sheet metal is stretched over the block-set form die assembly 14 to stretch form the product 12 to the surface contour 24 of the block-set form die assembly 14. A pliable sheet 25 may be disposed between the product 12 and the block-set form die assembly 14. The pliable sheet 25 operates to smooth the discontinuous surface contour 24 formed by the individual pins 20.

Figure 2:
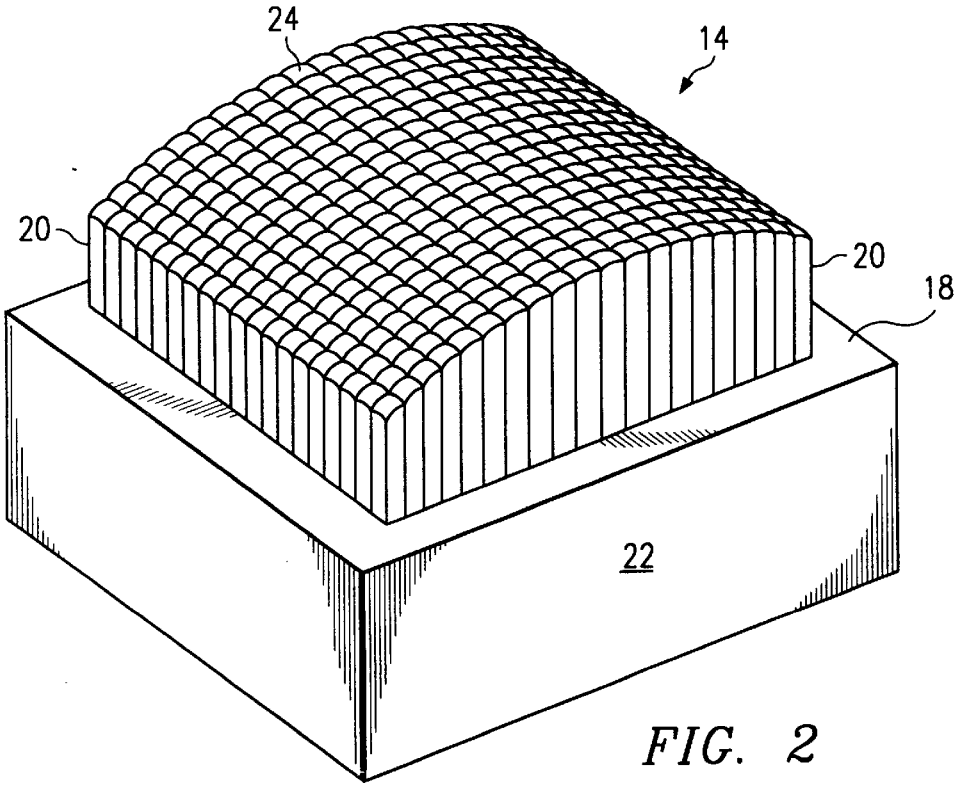
FIG. 2 is a perspective view of a block-set form die assembly of FIG. 1 in accordance with the present invention.

FIG. 2 is a perspective view of the block-set form die assembly 14. The block-set form die assembly 14 may comprise any number of pins 20. The number, size, and configuration of the pins 20 may be varied to produce various complex surface contours 24 in the product 12. For example, the greater the density of the pins 20 the finer the resolution and smoother the contoured shape of the product 12.

In another embodiment, the block-set form die assembly 14 is used to form a reconfigurable mold (not expressly shown). In this embodiment, a pliable sheet (not expressly shown) generally covers the pins 20 to form the molding surface of the reconfigurable mold. The surface contour 24 formed by the pins 20 forms the conforming contours within the reconfigurable mold. A molding material is then introduced into the reconfigurable mold to form the product 12. The shape, or contours, of the reconfigurable mold can be varied by changing the extension of the pins 20.

Figure 3:
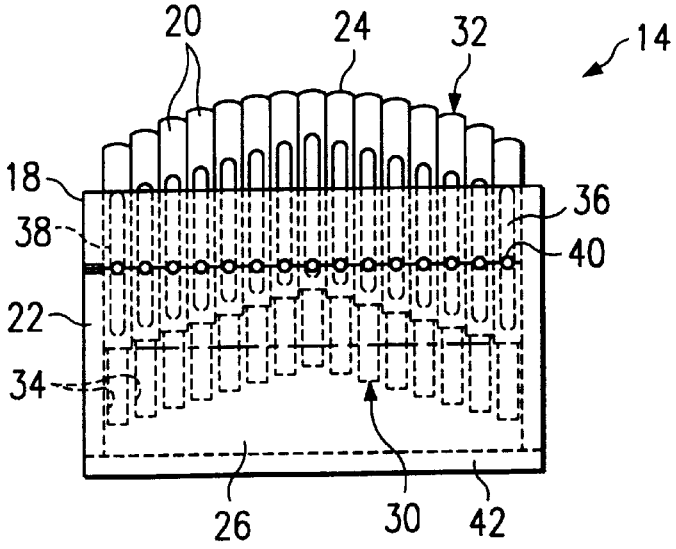
FIG. 3 is a cross-sectional side view of a block-set die form assembly of FIG. 2 in accordance with the present invention.

FIG. 3 is a cross-sectional side view of the block-set form die assembly 14. As discussed previously, the block-set form die assembly 14 also comprises a set-block 26 that sets the extension of the pins 20. The pins 20 have a first-end 30 and a second-end 32. The first-end 30 engages the set-block 26, and the second-end 32 forms the surface contour 24 that forms the product 12 shown in FIGS. 1A and 1B. As will be discussed in greater detail below, the first-end of the pins 20 are generally cylindrical. As best illustrated by FIG. 2, the second-end 32 of the pins 20 are generally rounded to improve the contact surface of the surface contour 24.

The set-block 26 may comprise a generally rectangular block having a number of pin cavities 34. The number of pin cavities 34 generally corresponds to the number of pins 20. Each pin cavity 34 has a depth that establishes the extension of the pin 20. In other words, the shallower the depth of the pin cavity 34, the greater the longitudinal extension of the pin 20. The variation in the depth of the pin cavities 34 establishes the surface contour 24 formed by the pins 20.

In the embodiment illustrated, the pin cavities 34 are cylindrical in shape. The first-end 30 of each pin 20 has a shape that allows the first-end 30 of each pin 20 to fit loosely within the corresponding pin cavity 34. The surface contour 24 can be easily changed by changing the depth of the individual pin cavities 34. The pin cavities 34 provide a self-aligning feature that allows the depth of the pin cavity 34 to be quickly and inexpensively changed. In addition, as will be discussed in greater detail below, the depth of the pin cavities 34 can also be varied by adding pin spacers of varying thicknesses.

In another embodiment, the set-block 26 has a machined contour (not expressly shown) fabricated into the surface of set-block 26 which matches, or sets, the surface contour 24. In this embodiment, the first-end 30 of each pin 20 contacts the machined contour of the set-block 26 and reproduces the machined contour as the surface contour 24.

The set-block 26 provides several advantages. For example, the set block allows the block-set die assembly 14 to be easily reconfigured to fabricate different products 12. In addition, the set-block 26 is smaller than many conventional form dies and is easier to store and maintain. Furthermore, the set-block 26 can be easily and cost effectively fabricated and reworked.

The block-set form die assembly 14 may also include a pin restraint system 36 for longitudinally restraining the pins 20 within the containment box 22. In one embodiment, the pin restraint system 36 comprises a longitudinal slot 38 in each pin 20 and a restraining rod 40 that extends through the longitudinal slot 38 of each pin 20 in each row of pins 20. In this embodiment, the longitudinal slot 38 in conjunction with the restraining rod 40 allows the pins 20 to move longitudinally without the pins 20 becoming decoupled from the containment box 22.

A restraining fixture 42 is often utilized to restrain the set-block 26 to the containment box 22. In one embodiment, as shown in FIG. 3, the restraining fixture 42 is a support structure coupled to the containment box 22. In another embodiment, the restraining fixture 42 is a number of securing bolts (not expressly shown) that couple the set-block 26 to the containment box 22. The restraining fixture 42 may comprise any suitable device or system for restraining the set-block 26 relative to the containment box 22.

Figure 4:
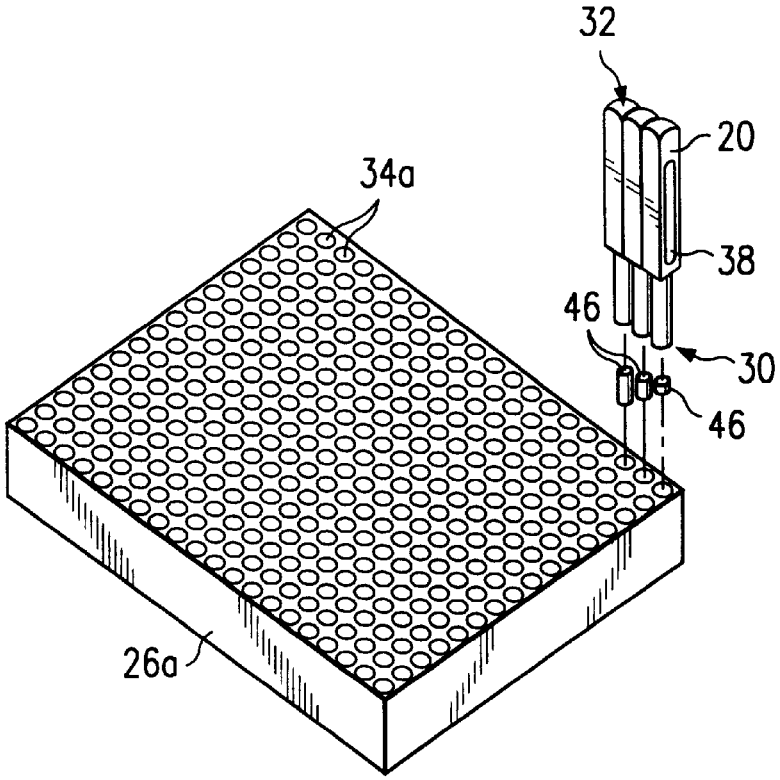
FIG. 4 is a perspective view of a set-block and pins in accordance with the present invention.

FIG. 4 is an exploded view of another embodiment of a set-block 26*a* and pins 20. In this embodiment, the set-block 26*a* comprises a number of pin cavities 34*a* and a number of pin spacers 46. The pin spacers 46 are sized to fit within the pin cavities 34*a*. In one embodiment, the depth of each pin cavity 34*a* is the same and the pin spacers 46 are used to vary the extension of the pins 20.

In this embodiment, the pin spacers 46 are generally removable from the pin cavities 34*a*.

In an embodiment in which the pin spacers 46 can be removed, the pin cavity 34*a* may extend through the set-block 26*a* to provide access for removal of the pin spacer 46. The removable spacers 46 allow the block-set form die assembly 14 to be modified quickly and efficiently without permanently machining any of the respective components. In a particular embodiment, a single set-block 26*a* may be utilized with various sized pin spacers 46 to change the surface contour 24. In this embodiment, the pin-spacers 46 are changed to produce each different surface contour 24, instead of changing the entire set-block 26*a*.

In an embodiment in which the pin spacers 46 are permanently secured within the pin cavities 34*a*, the pin spacers 46 are often utilized to correct an over drilled pin cavity 34*a* or for reworking a set-block 26*a* to a new configuration. In this embodiment, pin spacers 46 are not generally used in each pin cavity 34*a*. It will be understood that the configuration of the set-block 26 may be suitably varied without departing from the scope of the present invention.

Although the present invention has been described in several embodiments, various changes and modifications may be suggested to one skilled in the art. It is intended that the present invention encompass such changes and modifications that fall within the scope of the appended claims.

What is claimed is:

1. A block-set form die assembly comprising:

a pin box having a plurality of pins disposed within a containment box, each pin having a fixed length and operable to longitudinally extend and form a surface contour for forming a product;

a set-block engaging the pins and comprising a pin cavity corresponding to each pin, each pin cavity having a fixed depth; and a spacer having a fixed length disposed within at least one pin cavity, wherein the set-block and the spacer are operable to set the longitudinal extension of the pins.

2. The block-set form die assembly of claim 1, wherein the depth of each pin cavity is substantially the same.

3. The block-set form die assembly of claim 1, further comprising a pin restraint system operable to limit the longitudinal extension of the pins within the containment box.

4. The block-set form die assembly of claim 3, wherein the pin restraint system comprises a lateral slot in each pin and a restraining rod that engages the lateral slot of each pin in a row of pins.

5. The block-set form die assembly of claim 1, further comprising a restraining fixture for securing the set-block to the containment box.

6. The block-set form die assembly of claim 1, wherein each pin has a first-end and a second-end, with the first-end having a substantially cylindrical shape and the second-end having a substantially rectangular shape.

7. The block-set form die assembly of claim 1, wherein the product is fabricated from sheet metal.

8. A tooling die assembly for fabricating a product, the tooling die assembly comprising:

a block-set form die assembly having:

a pin box having a plurality of pins disposed within a containment box, each pin having a fixed length and operable to longitudinally extend and form a predetermined surface contour; and a set-block engaging the pins and comprising a pin cavity corresponding to each pin, each pin cavity having a fixed depth; and a spacer having a fixed length disposed within at least one pin cavity, wherein the set-block and the spacer are operable to set the longitudinal extension of the pins; and a reactive load assembly operable to react a force on the product and shape the product to the predetermined surface contour.

9. The tooling die assembly of claim 8, further comprising a pliable sheet disposed between the surface contour and the product.

10. The tooling die assembly of claim 8, wherein the product is fabricated from sheet metal.

11. A method of fabricating a product comprising:

providing a reactive load assembly;

providing a block-set form die assembly comprising:

a pin box having a plurality of pins disposed within a containment box, each pin having a fixed length and operable to longitudinally extend and form a predetermined surface contour;

a set-block engaging the pins and comprising a pin cavity corresponding to each pin, each pin cavity having a fixed depth; and a spacer having a fixed length disposed within at least one pin cavity;

setting the longitudinal position of the pins with the set-block and the spacer; and pressing a blank between the reactive load assembly and the block-set form die assembly to shape the product.

12. The method of claim 11, wherein the blank is fabricated from sheet metal.

13. The method of claim 11, wherein the block-set form die assembly further comprises a containment box operable to laterally restrain the pins.

14. The method of claim 11, wherein the block-set form die assembly further comprises a pin restrain system operable to restrict the longitudinal position of each pin.

15. A block-set form die assembly comprising:

a pin box having a plurality of pins disposed within a containment box, each pin operable to longitudinally extend and form a surface contour for forming a product; and a set-block comprising a pin cavity corresponding to each pin, each pin cavity having a fixed depth, the fixed depths having differing lengths for forming a set-block contour associated with the surface contour, wherein the set-block is operable to engage the pins and set the longitudinal extension of the pins at positions corresponding to the surface contour.

16. The block-set form die assembly of claim 15, wherein the set-block comprises a spacer disposed within at least one pin cavity.

17. The block-set form die assembly of claim 15, further comprising a pin restraint system operable to limit the longitudinal extension of the pins within the containment box.

18. The block-set form die assembly of claim 17, wherein the pin restraint system comprises a lateral slot in each pin and a restraining rod that engages the lateral slot of each pin in a row of pins.

19. The block-set form die assembly of claim 15, further comprising a restraining fixture for securing the set-block to the containment box.

20. The block-set form die assembly of claim 15, wherein each pin has a first-end and a second-end, with the first-end having a substantially cylindrical shape and the second-end having a substantially rectangular shape.

21. The block-set form die assembly of claim 15, wherein the product is fabricated from sheet metal.

* * * * *